United States Patent [19]

Spitz

[11] 3,984,884

[45] Oct. 12, 1976

[54] BED FRAME HAVING RELEASABLY INTERLOCKED SIDE RAILS AND CROSSBARS

[76] Inventor: Melvin P. Spitz, 619 N. Elm Dr., Beverly Hills, Calif. 90210

[22] Filed: May 14, 1975

[21] Appl. No.: 577,172

Related U.S. Application Data

[63] Continuation-in-part of Ser. No. 556,914, March 10, 1975.

[52] U.S. Cl. ..... 5/176 R; 5/201; 5/202; 5/238; 403/230

[51] Int. Cl.[2] ..... A47C 23/06

[58] Field of Search ..... 5/176, 201, 202, 238, 5/287, 300, 304; 108/108, 110; 312/108, 111, 263; 211/176; 403/187, 230, 234, 237

[56] References Cited

UNITED STATES PATENTS

| | | | |
|---|---|---|---|
| 2,008,087 | 7/1935 | Stromberg | 5/300 |
| 3,136,530 | 6/1964 | Case | 403/230 |
| 3,510,887 | 5/1970 | Spitz | 5/176 R |
| 3,537,114 | 11/1970 | Mis | 5/201 |

*Primary Examiner*—Casmir A. Nunberg
*Attorney, Agent, or Firm*—Whann & McManigal

[57] ABSTRACT

A bed frame of the knockdown type having a pair of side rails and at least one connected end crossbar cooperable to provide a supporting frame structure for an associated box spring, in which brackets on the side rails are formed to provide sockets for respectively laterally receiving associated end portions of a crossbar therein into seated position where coacting parts respectively on the brackets and crossbar have interlocking engagement and function to retain the end portion of the crossbar against endwise withdrawal from the associated socket.

The crossbar and side rail connection, as noted above, provides an extremely rigid box-like structure which permits frame-supporting leg assemblies to be mounted on the crossbar at a sufficiently inwardly spaced position from the side rail to avoid possible injurious striking of the bare foot or stubbing of toes thereon.

Unique adjustable offset box spring locating and retaining clips are also provided on the side rails to permit the sides of the box spring to extend beyond the side rails.

Each crossbar is constructed with unique adjustable sections permitting the bed frame to be readily adjusted to selectively provide a twin, double or queen size, or queen or king size without the use of tools.

18 Claims, 17 Drawing Figures

FIG. 1.
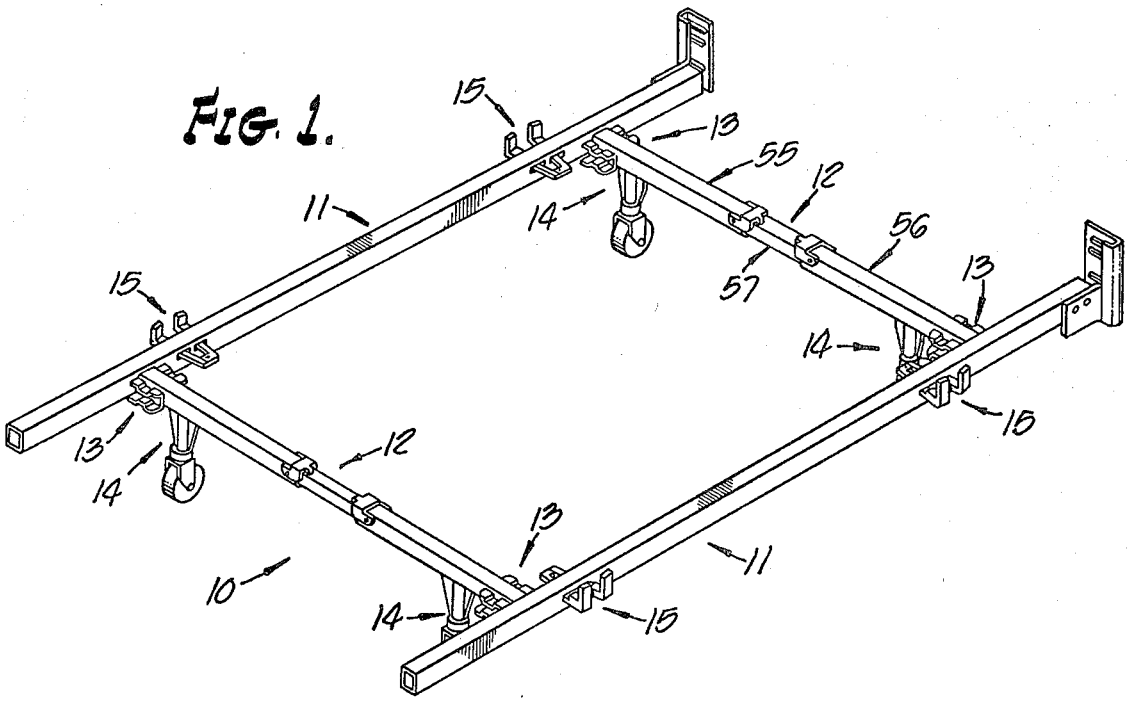
FIG. 3.
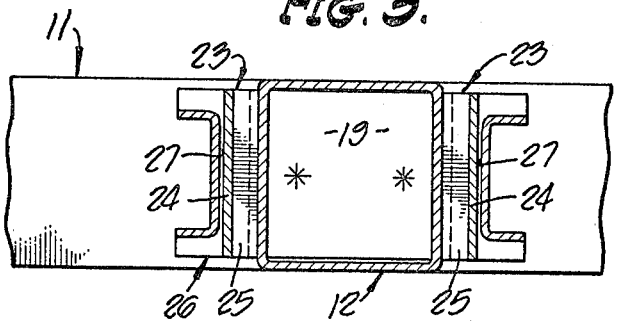
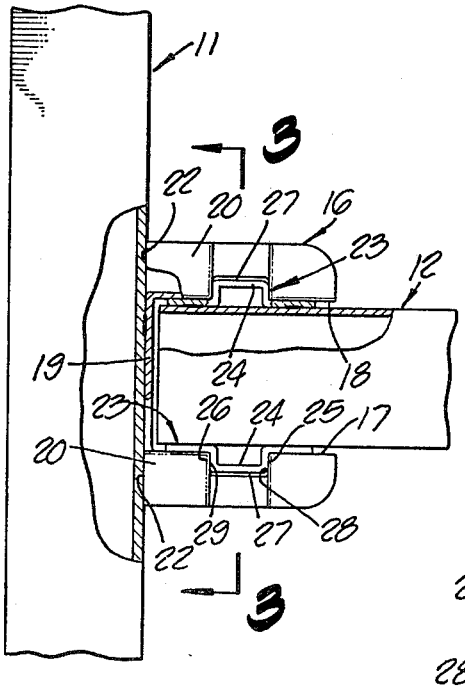
FIG. 2.
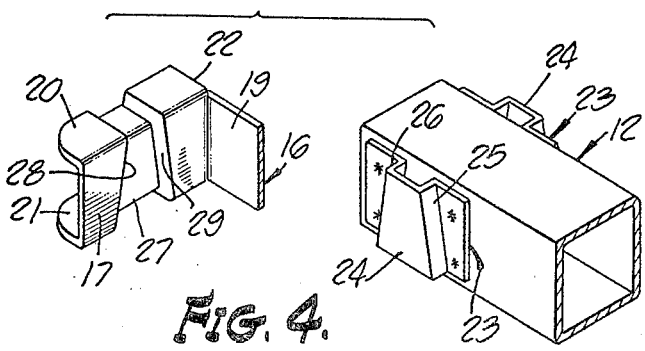
FIG. 4.

FIG. 14.
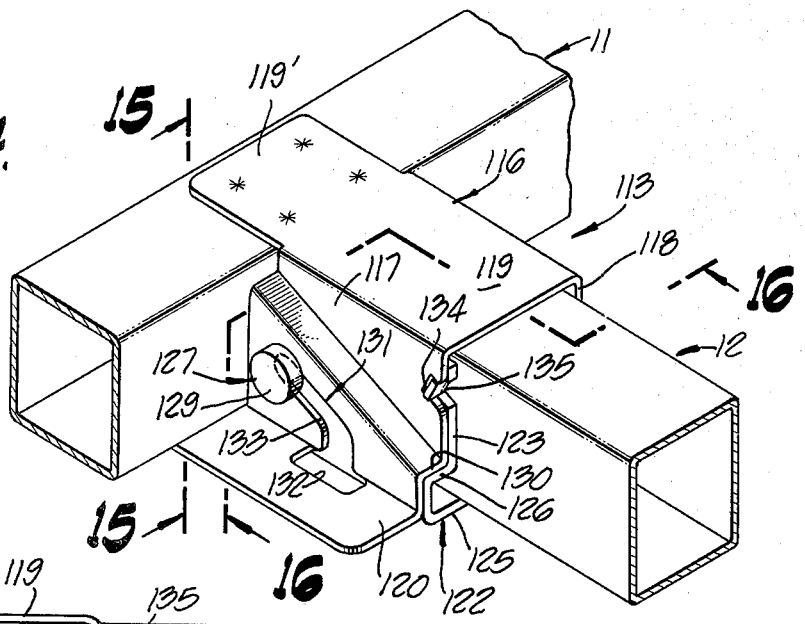
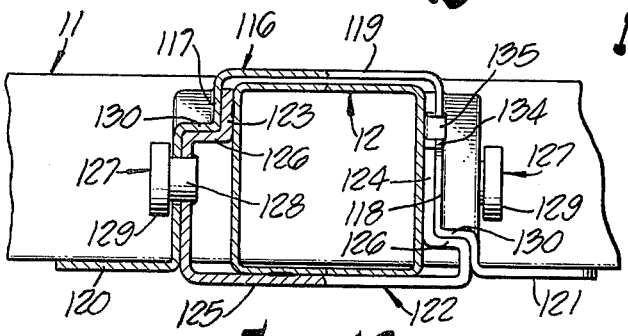
FIG. 16.
FIG. 15.
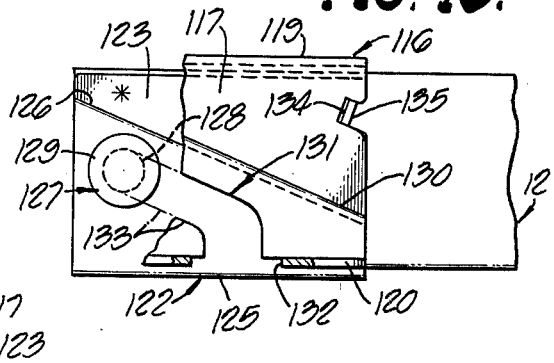
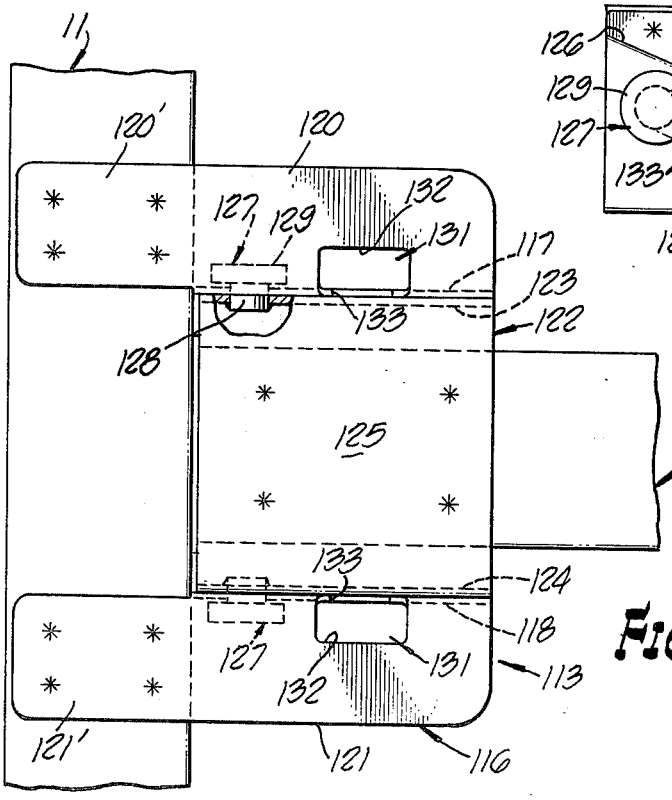
FIG. 17.

BED FRAME HAVING RELEASABLY INTERLOCKED SIDE RAILS AND CROSSBARS

This application is a continuation-in-part of my pending prior Application Ser. No. 556,914, filed Mar. 10, 1975.

BACKGROUND OF THE INVENTION

The present invention relates to beds generally and to bed frame structures specifically of the knockdown type.

It has heretofore been generally known from U.S. Pat. Nos. 3,537,114 and 3,683,429 to provide a bed-frame assembly of the knockdown type in which a cross frame member is Detachably secured to side frame members. In these patents, interfitting male and female members are utilized, one of the members being secured to the side frame member and the other being mounted on an associated end of the cross frame in a manner to extend transversely across and spaced from the end terminus of the connected cross frame. The design configuration of the male and female members, as disclosed in these patents, is rather complex and expensive to produce, and have an orientation such that in their assembled relation the parts do not provide as great rigidity as might be desired. For example, the rigidity of the connection between the side frame member and cross frame member is not sufficiently rigid to permit the mounting of frame supporting leg assemblies on the cross frame at a sufficiently inwardly spaced position from the side frame to avoid injurious striking of a person's bare feet or stubbing one's toes thereon. As a consequence, these patents disclose the supporting leg assemblies as being secured to the connection means and thus have the disadvantage of extending immediately below the side frame members in a position where they constitute a dangerous hazard.

The present invention obviates the above noted problems and inherent disadvantages of the patented arrangements by providing a simplified and extremely rigid structural concept for releasably interconnecting the side rail and a crossbar end, in which a bracket on the side rail is so formed as to provide a box-like structure having an elongate socket extending inwardly at a right angle to the side rail, the socket being designed to laterally receive an end portion of the crossbar into a seated position which is coaxial with the longitudinal axis of the socket. In the seated position of the crossbar end, coacting parts respectively on opposite sides of the bracket and crossbar have interlocking engagement and function to retain the crossbar against endwise withdrawal from the socket. An extremely high order of rigidity is thus obtained, so that it now becomes possible to provide a frame supporting leg assembly which may be secured directly to the crossbar end portion independently of the interconnecting means at the desired inwardly spaced position with respect to the side rail and thus minimize the possibility of injury.

Further, it has been generally known to provide box spring locating and retaining clips on the side rails of bed frames. As shown in the previously noted patents, these clips may be permanently secured as by riveting at desired locations along the side rails, or as disclosed in U.S. Pat. No. 3,510,887, these locating clips may be attached to the side rail in a manner permitting their selectively adjustable movement along the rail and location at any desired position.

While the known retaining clips as shown in the above patents operate more or less satisfactorily in most cases, it will be appreciated that because of variations in the manufactured widths of box springs, the clips of the above discussed character may not always firmly engage the sides of the box spring.

The above noted drawbacks are avoided by the adjustable clip structure of the present invention, which enables the clip to be adjustably extended and retracted and latched in adjusted operating position in which it firmly grips the edge of the box spring structure.

It has also been known generally, as exemplified by U.S. Pat. Nos. 3,646,623 and 3,781,930, to provide a bed frame structure in which the side rails are interconnected by one or more longitudinally adjustable crossbars by means of which the bed frame may be selectively varied as to width in order to provide a plurality of standard bed widths, for example, a twin, double or queen size bed without the use of tools.

The present invention embodies a unique highly effective but simplified arrangement in which the crossbar is composed of telescoped sections which are interconnected for telescoping limited extendable and retractable longitudinal movements. At their adjacent overlapped ends, the outermost of the telescoped sections is provided at its end terminus with a pivoted locking clip which is manually swingable between a released position and a locking position wherein it lays flat against a side face of the section. The innermost of the telescoped sections carries a plurality of transversely extending slots which are spaced longitudinally along the section at distances corresponding to the respective bed widths, each of these slots at a selected bed width being adapted to receive a tongue projection of the locking clip, when the clip is in locking position. The tongue projection, while positioned in a slot, effectively anchors the telescoped sections against longitudinal movements, but upon swinging movement of the locking clip to its released position will readily enable the crossbar to be adjusted to another bed width and locked.

SUMMARY OF THE INVENTION

The present invention relates to bed frame structures, and is more specifically concerned with improvements for facilitating the interconnection and adjustment of the bed frame components.

It is an important object and feature of the herein described invention to provide an improved bed frame of the knockdown type having side rails and interconnecting crossbars; which is capable of being quickly assembled; which does not require the use of small parts, such as bolts, nuts or clamps; and which requires no tools for effecting the assembly of disassembly of the respective components.

A further object of the invention is to provide a bed frame according to the foregoing object, wherein a bracket secured to a side rail is so formed as to provide a box-like structure of extremely high mechanical strength; which contains an enlongated socket with an axis in right-angled relation to the side rail for receiving an end portion of a crossbar therein into coaxial relation; and which includes unique releasable interlocking means for preventing endwise separation of the connected crossbar, and relative vertical tilting movements of the bracket with respect to the connected crossbar end.

A still further object is to provide improved means for releasably connecting the side rail and crossbar of a bed frame in which a fixed connection bracket on the side rail overlies an end portion of the connected crossbar in a manner such that the weight of a supported box-spring will act to retain the bracket and crossbar end in connected relation; and in which the weight of the box-spring will be supported on inclined interfacing surfaces carried by the bracket and crossbar end portion, the inclination of such surfaces being such that upon attempted horizontal separation of the bracket and the crossbar, the coaction of the interfacing surfaces to raise the bracket will be opposed by the downwardly weight acting force of the box-spring.

A still further object of the invention is to provide a bed frame which embodies unique means of simple construction for interconnecting the ends of the crossbars with the side rails; and which will be sufficiently rigid to permit the mounting of bed frame supporting leg assemblies directly on the crossbars at positions inwardly spaced from the side rails to such extent that bodily injury as by striking bare feet or stubbing of the toes against the leg assemblies, will be averted.

In conventional bed frames it has been known to provide the side rails with fixed box spring retaining tabs or clips in order to recess the otherwise unsightly and potentially hazardous side rails so that they will be concealed by the overhanging sides of the box spring. These fixed tabs or clips were not entirely satisfactory for the reason that in some cases the clips projected beyond the sides of the box spring and thus constituted a dangerous hazard.

With a view to correcting the foregoing problem, it is a further object of the invention to provide an improved and unique box spring retaining clip which is adjustably extendable and retractable, without the use of tools, so as to snugly engage the sides of the box springs which may vary slightly as to their widths.

Another object is to provide a unique sectionalized crossbar which is adjustable without the use of tools to selectively vary the width of a bed frame to provide, e.g., a twin, double or queen size bed; in which the crossbar is composed of adjustable telescoped sections which cannot be disengaged completely; which is devoid of loose parts such as nuts or clamps; and which embodies a simple and effective mechanism for releasably locking the sections in a selected adjusted position.

Further objects of the invention will be brought out in the following part of the specification, wherein detailed description is for the purpose of fully disclosing the invention without placing limitations thereon.

BRIEF DESCRIPTION OF THE DRAWINGS

Referring to the accompanying drawings, which are for illustrative purposes only:

FIG. 1 is a perspective view of a bed frame structure embodying the features of the present invention;

FIG. 2 is an enlarged fragmentary plan view, partly in section, showing details of the releasable connection between a bed side rail and associated crossbar according to the present invention;

FIG. 3 is a transverse sectional view taken substantially on line 3—3 of FIG. 2;

FIG. 4 is an exploded perspective view showing details of the interlocking parts of the connection between the crossbar and side rail;

FIG. 14 is an enlarged fragmentary perspective view showing a modified embodiment of the connecting means for crossbar and side rail;

FIG. 15 is a fragmentary side elevational view of the same, portions being cut away, as seen from line 15—15 of FIG. 14;

FIG. 16 is an enlarged generally transverse sectional view, taken substantially on line 16—16 of FIG. 14; and FIG. 17 is a fragmentary bottom plan view of the modified embodiment.

DESCRIPTION OF THE PREFERRED EMBODIMENTS

Figures 5, 6, 7, 8, 9, 10, 11, 12, 13:
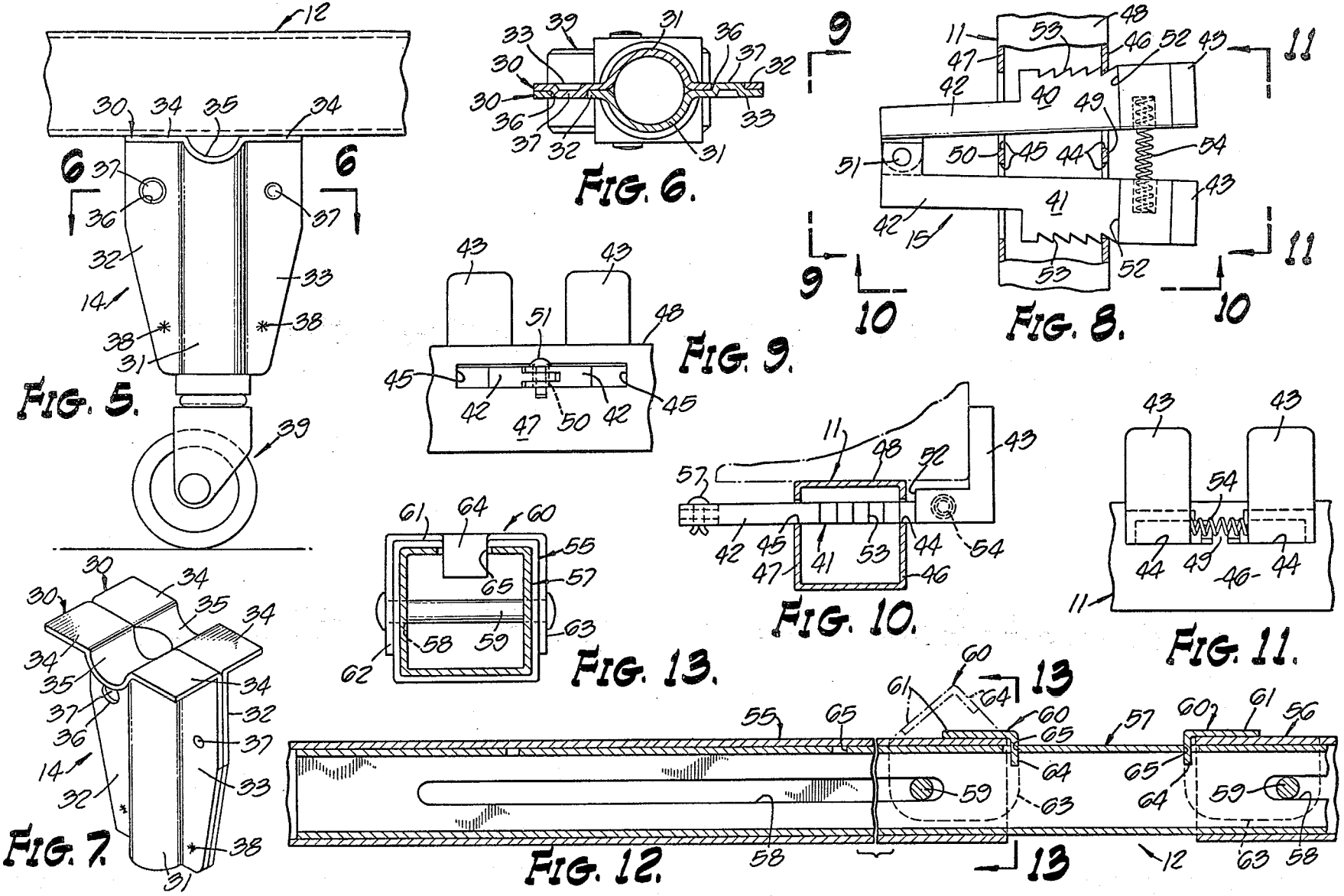
FIG. 5 is a fragmentary elevational view of a bed frame supporting leg assembly as embodied in the present invention.
FIG. 6 is a transverse section of the leg assembly, taken substantially on line 6—6 of FIG. 5.
FIG. 7 is a perspective view showing structural details of the leg structure.
FIG. 8 is a fragmentary plan view of an adjustable box spring retaining clip according to the present invention, and showing the manner in which it is mounted on an associated side rail.
FIG. 9 is an elevational view, partly in section, of the rail mounted clip, as viewed substantially along line 9—9 of FIG. 8.
FIG. 10 is a side elevational view of the same, partly in section, as seen substantially on line 10—10 of FIG. 8.
FIG. 11 is an elevational view of the outer end of the rail mounted clip, partly in section, as seen substantially on line 11—11 of FIG. 8.
FIG. 12 is a fragmentary vertical sectional view taken through one of the frame crossbars, showing the telescoped sections and locking clip for anchoring the bar in adjusted position.
FIG. 13 is a transverse sectional view of the same taken substantially on line 13—13 of FIG. 12.

Referring now specifically to the drawings, for illustrative purposes, a bed frame embodying the features of the present invention is indicated in its entirety by numeral 10 in FIG. 1, and is shown as comprising a pair of spaced parallel side rails 11 which are interconnected by one or more perpendicularly extending crossbars 12. The crossbars are releasably connected at their end portions by connecting means as generally indicated at 13, to provide an assembled bed frame structure for supporting an associated box spring, the assembled bed frame being supported in an elevated position by means of leg assemblies, as generally indicated at 14. The leg assemblies are respectively mounted directly on the end portions of the crossbars and are sufficiently inwardly spaced from the side rails to avoid injurious striking with one's bare feet or stubbing one's toes thereon.

The side rails are provided with adjustable box spring retaining tabs or clips 15 which are so designed that they may be selectively adjusted so as to snugly fit against the sides of the supported box spring. This arrangement enables the box spring to be positioned so as to extend beyond the associated side rails, and thus conceal the rails which otherwise would be conspicuous, unsightly and hazardous. The clip structure of the present invention, as will be more fully explained later, avoids the inherent disadvantages of the conventional fixed clip which under certain conditions may extend beyond the sides of the supported box spring in such a manner as to provide a dangerous hazard.

The Crossbar-Side Rail Connecting Means

In the present invention, it is a main design objective to provide rail and crossbar structures and connecting means of a character which will produce a bed frame assembly having great rigidity. The side rails and crossbars may comprise standard multisided extrusions of conventional form, but preferably are tubular form having flanges or side walls in right-angled relation. Another feature of the connecting means of the present invention is that connections are made with an end portion of the crossbar at a zone which is inwardly spaced from the crossbar end terminus.

More specifically, as best shown in FIGS. 2–4, the connecting means 13 comprises a generally U-shaped side rail bracket 16 in which spaced apart side walls 17 and 18 extend outwardly from an integrally formed bridging wall 19 which is secured to a side flange of the side rail as by welding or other appropriate means. Each side wall of the bracket is further strengthened and rigidified by providing outwardly extending flanges 20 and 21 respectively at the upper and lower edges of the side wall. These flanges each have an inner end edge 22 adjacent the bridging wall 19 which is adapted to bear against the adjacent wall surface of the associated side rail on which the bracket is mounted.

The bracket, as thus far described, provides in effect an elongate socket having an axis extending at right-angles to the connected side rail, this socket being adapted to laterally receive an end portion of a connected crossbar 12 in an upward direction into a seated position with the axis of the crossbar end portion coaxial with the axis of the socket.

In the seated position of the crossbar end portion in an associated bracket 16, coacting parts respectively on the bracket and crossbar end portion are provided to make interlocked engagement and retain the end portion of the crossbar against endwise withdrawal from the socket. For this purpose, the end portion of the crossbar 12 is provided with transversely aligned clips or fastening members 23 which are respectively secured to the side walls of the crossbar end portion by means of welding or other suitable means. Each fastening member is deformed to provide an outwardly offset projecting tongue 24 with upwardly converging side wall portions 25 and 26 to form in effect a wedge.

The tongue 24 is adapted in the seated position of the end portion of the crossbar to interfittingly coact with an outwardly offset recessed groove 27 on the adjacent bracket wall and having side wall portions 28 and 29 which upwardly converge to form a wedging groove compatible with the wedge 24.

With the interconnecting means as described above, the side rails and crossbars may be assembled to form the bed frame without the use of tools, and when so assembled provide a very rigid connection which makes it possible to secure the respective leg assemblies 14 directly to the crossbar end portions at positions inwardly spaced from the side rails so as to minimize the possibility of bodily injury.

The leg assembly 14 according to the present invention is shown in FIGS. 5, 6 and 7 as comprising a pair of similarly deformed members 30 which are secured together to form the leg assembly. Each member is stamped or otherwise formed to provide an integrally formed body with a longitudinally extending semicircular central portion 31 with diametrically opposed outwardly extending flanges 32 and 33, these flanges being preferably tapered in their lowermost end portions. The uppermost end is deformed to provide a substantially right-angled flange 34 having a transversely extending semicircular portion 35. The flange 32 adjacent its uppermost end is provided with a circular opening 36 while the flange 33 on the opposite side is provided with an inwardly upset circular projection 37.

As will best be seen in FIG. 6, the opening 36 and circular projection of the pairs of members 30 serve as guides to initially properly position the members in assembled relation with their side flanges 32 and 33 in engagement. As thus initially assembled, the pair of members may be fixedly secured together as by spot welding as indicated at 38, or other suitable means.

As thus assembled, the pair of members 30 cooperate to form a tubular portion at their lowermost ends to recceive the mounting shank or stem (not shown) of a conventional caster 39. The uppermost ends of the connected pair of members cooperate to provide an end flanged structure which can be secured as by welding or other suitable means to the lowermost flange or side wall of the associated crossbar 12.

The Box Spring Retaining Clips

Referring now to FIGS. 8–11, the box spring retaining clips 15 are constructed as unitary assemblies which can be mounted in the side rails 11, and as thus mounted may be adjustably extended and retracted with respect to the associated side rail so as to snugly engage the adjacent side of the box spring.

Each clip assembly is of a generally L-shaped configuration, and comprises a pair of L-shaped members 40 and 41 which may be formed of injection-molded plastic, or other suitable material, to provide in each case an elongate base leg 42 and a shorter right-angled end leg 43. As shown in FIG. 8, each leg 42 is positioned for sliding movement in transversely aligned slots 44 and 45 respectively in an outer flange wall 46 and inner flange wall 47 of the associated side rail. As thus mounted, the base leg is disposed below the upper flange wall 48 of the side rail. It will be noted that the adjacent ends of the slots 44 are separated by a narrow web 49, while the slots 45 have their adjacent ends separated by a narrow web 50.

The outermost ends of the base legs 42 are hingedly interconnected for relative swinging movement by means of a pivot pin 51 which also forms a stop which limits the movement of the connected members 40 and 41 in an outward direction to a position which would permit their detachment from the associated rail. Movement in an opposite direction is limited by abutment projections in the form of a shoulder 52 in each case which is inwardly spaced from the leg 43. The members 40 and 41 are provided in each case with a series of serrations 53 along their outer marginal edge for engagement with adjacent edges of the slots 44, when the outermost ends of the members are urged apart by means of a coiled spring 54 extending therebetween. However, by pressing the outermost ends of the members 40 and 41 towards each other, the serrations will be moved into disenaged positions which will permit adjustment of the clip to a desired position in transverse relation to the associated side rail. Upon releasing the pressure on the outer ends of the members, the spring 54 will again urge the members into an adjusted latched position.

The Adjustable Crossbar Structure

The crossbars 12 are longitudinally adjustable and arranged to be locked in adjusted position so as to enable the width of the bed frame to be selectively varied to provide a plurality of different bed widths.

More specifically, as best shown in FIGS. 12 and 13, each crossbar is provided with telescoped sections. As illustrated, the crossbar is composed of two end sections 55 and 56, and a central section 57 which has its end portions telescoped within the adjacent end portions of the end sections 55 and 56. The crossbar sections are fabricated from multisided extruded members, and for strength are preferably comprised of tubular members having a rectangular cross-section.

The telescoped end of each end section and an end of the central section are interconnected for limited longitudinal axial adjustment. For this purpose, the end portion of the central section 57 is provided on its opposite side walls or flanges with transversely aligned elongate slots 58. A transversely extending pin 59 is positioned adjacent the end terminus of the telescoping end of the end section, this pin extending through the slots 58 and the adjacent side walls of the telescoped end portion of the end section and in which the pin ends are fixedly anchored. As thus arranged, the telescoped sections of the crossbar are adjustably connected to provide a unitized crossbar structure in which the separate sections are not readily disconnectable into separate parts.

In order to releasably lock the telescoped sections of the crossbar in an adjusted position, the inner telescoped end of each end section is provided with a swingably mounted clip 60 which is fabricated from a suitable flat material to provide a generally U-shaped configuration having a bridging portion 61 and integrally formed spaced side leg portions 62 and 63, which are adapted to conform to the top and side walls of the end section. The clip is pivoted for swinging movement on the end portions of the pin 59 which are extended through the side leg portions 62 and 63 of the clip. As thus pivoted, the clip is swingable between a locking position as shown in full lines in FIG. 12, and a non-locking position as indicated in phantom lines. The clip is provided on its bridging portion 61 with an angularly extending tongue projection 64 which is adapted, in the locking position of the clip, to extend over the inner end terminus of the end section upon which the clip is mounted.

The associated telescoped end portions of the central section are provided in their upper wall or flange with a series of longitudinally spaced apart transversely extending slots 65 which are determinative of the various bed widths. In each adjusted position, the tongue 64 in the locked position of the clip is adpated to extend into the selected slot for an adjusted bed width, and in this position serves to lock the crossbar sections against longitudinal movement. The clip 60 as thus constructed has the advantage that, in locked position, the bridging portion 61 will lie flatly against the adjacent side of the associated tubular member. As a consequence, there are no projecting portions above the crossbar which will interfere or prevent supporting engagement thereon by the associated box spring. Also, the box spring tends to retain the clip in its locking position.

Modified Embodiment of Crossbar-Side Rail Connecting Means

Referring to FIG. 14, there is shown a modified form of the crossbar and side rail connecting means previously shown and discussed. The overall purpose and operation of the modified form is in its broad aspects similar to the previously described construction, but has been modified in order to incorporate certain desirable structural innovations which provide greater strength, and also a structure which incorporates components which effectively retain the side wall bracket against vertical tilting movements with respect to the connected crossbar end portion.

More specifically, there is shown in FIG. 14 connecting means 113 which comprises a generally U-shaped side rail bracket 116 in which spaced apart side walls 117 and 118 extend downwardly from an integrally formed bridging wall 119. At their lowermost ends, the side walls 117 and 118 are respectively provided with integrally formed right-angled oppositely extending flanges 120 and 121. As shown in FIGS. 14 and 17, the bridging wall 119 is provided with an inner end extension 119', and the flanges 120 and 121 respectively with inner end extensions 120' and 121', which are arranged to extend over and to be bondingly secured to the upper and lower wall surfaces of the side rail on which the bracket is mounted. This type of mounting provides great strength at the interconnection of the bracket with the associated side rail.

In the seated position of the crossbar end portion in the side rail bracket 116, as shown in FIG. 14, coacting parts are provided to interlockingly retain the crossbar against endwise separation from the bracket, and also prevent spreading of the side walls of the bracket, as well as vertical tilting movements of the bracket with respect to the end portion of the crossbar.

The end portion of the crossbar 12 in this embodiment is provided with a generally U-shaped mounting bracket 122 which is formed with side legs 123, 124 and a connecting bridging portion 125 which are welded or otherwise secured to the corresponding associated wall portions of the crossbar end portion. Each of the side legs 123, 124, is outwardly offset to provide an inclined shoulder 126 which extends outwardly and downwardly from the rear edge to the forward edge of the leg.

Below the shoulder 126 and in a position adjacent the rear edge of the bracket 122, a stud 127 has a shank portion 128 welded or otherwise secured so that its overhanging head portion will be outwardly spaced from the adjacent surface of the associated side leg of the bracket.

For cooperative association with the shoulder 126, each of the side walls of the side rail bracket 116 is outwardly offset to provide an inclined shoulder 130 having an underlying surface which is arranged to interface with the upper surface of the shoulder 126, when the crossbar end portion is seated in the socket of the side rail bracket.

Each bracket side wall below the shoulder 130 is fabricated to provide an inverted T-slot 131 which is fabricated with a wide head portion 132 formed in the bracket flange 120 or 121, in each case, and which communicates with a narrow slot portion 133 which is angularly upwardly inclined towards the rear of the bracket in a parallel direction below the inclined shoulder 130.

The stud and slot arrangement, as just described, permits the side rail bracket to be moved from a position above the crossbar end into a seated position by inserting the heads of the studs 127 into the enlarged head portions of the T-slots and then by downward movement causing the studs to travel through the narrow portions of the slots to a final seated position of the crossbar end portion in the side rail bracket.

The outer ends of the bracket side walls 117 and 118 are provided respectively with an edge opening slot 134 which is positioned above the inclined shoulder 130 and inclined so that its axis is in parallel relation to the inclined shoulder. Each of the slots 134 is arranged to receive a tongue projection 135 which may be struck-up or otherwise formed on each of the side legs 123 and 124 of the mounting bracket 122 of the crossbar end portion. With the arrangement shown, it will be seen that the tongue projection 135 will enter the edge opening slot 134 during the final seating movement of the crossbar and side rail bracket. The studs 127 and tongue projections 135 and their associated slots function to interlock the side rail bracket and connected crossbar end portion in a manner to prevent vertical tilting movements of the side rail bracket with respect to the crossbar.

A further important feature of the construction described above is that the side rail bracket overlies the connected end portion of the crossbar, and the weight of the supported box spring will be applied against the upper wall surfaces of the side rail and the bridging wall 119 of the side rail bracket in such a way that his weight force will bear against the interfacing surfaces of the inclined shoulders 126 and 130. It will thus be apparent that any attempt to disconnect the side rail from the crossbar by outward movement of the former will, by virtue of the inclined interfacing shoulders 126 and 130, cause an upward movement of the side rail and bracket against the weight of the supported box spring in a manner which will oppose inadvertent separation of the side rail from the connected crossbar end portion.

From the foregoing description and drawings, it will be clearly evident that the delineated objects and features of the invention will be accomplished.

Various modifications may suggest themselves to those skilled in the art without departing from the spirit of my invention, and, hence, I do not wish to be restricted to the specific forms shown or uses mentioned, except to the extent indicated in the appended claims.

I claim:

1. In a bed frame having a pair of side rails and at least one end crossbar interconnected to provide a supporting frame structure for an associated box spring, the improvement in which an end of the crossbar is releasably connected with a side rail by means, comprising:

a. a bracket secured to the side rail, said bracket having walls coacting to form a socket for receiving an end portion of the connected crossbar into a seated position therein, said socket having a longitudinal axis extending parallel to the axis of the end portion of said crossbar seated therein, and said walls including spaced apart side walls lying on opposite sides of said axis;

b. said end portion of said crossbar having spaced apart side walls lying on opposite sides of its longitudinal axis, said side walls of said crossbar in said seated position being respectively juxtaposed to said side walls of said socket; and c. coacting parts between each of the juxtaposed side walls for interlocking engagement in said seated position to retain said end portion and said socket against axial separation, said parts including interconnectable stud and slot means.

2. A bed frame as set forth in claim 1, wherein said bracket is formed to provide a generally U-shaped configuration with said socket forming walls extending downwardly in parallel spaced relation from an upper bridging portion and respectively having outwardly extending right-angled bottom flanges, said bridging portion and said flanges having inner end extensions extending over and being secured to upper and lower wall surfaces, respectively of the associated side rail on which said bracket is mounted.

3. A bed frame as set forth in claim 1, wherein said stud and slot means interconnects the socket side walls and the associated side walls of the crossbar end portion in a manner to oppose spreading of the socket side walls.

4. A bed frame as set forth in claim 3, in which said stud is fixedly secured with respect to a side wall of the crossbar end portion and the associated slot is formed in a socket side wall.

5. A bed frame as set forth in claim 2, in which the coacting parts include engageable interfacing surfaces respectively carried by the juxtaposed side walls and longitudinally extending generally along the longitudinal axes of said socket and seated end portion of the crossbar, and the slot is positioned below the interfacing surface of the socket side wall.

6. A bed frame as set forth in claim 4, wherein said stud is mounted on one of the spaced legs of U-shaped bracket having its legs and bridging portion bonded to corresponding associated wall portions of the crossbar end portion.

7. A bed frame as set forth in claim 6, in which the bridging portion of the U-shaped bracket is bonded to a bottom wall portion of the crossbar end portion.

8. A bed frame as set forth in claim 6, wherein each of the studs has a radially projecting head portion and a shank portion, each of the slots in a T-slot with a wide portion for initially receiving the stud head and a narrow portion for receiving the shank portion of the stud, in the seated position of said crossbar end portion in said socket.

9. A bed frame as set forth in claim 8, in which the narrow portion of said slot includes an inclined inner end portion extending in substantially parallel relation along the interfacing surface of the socket side wall.

10. A bed frame as set forth in claim 8, wherein the stud in the seated position of the crossbar end portion is positioned closely adjacent to the connected side rail.

11. A bed frame as set forth in claim 8, in which the wide portion of the slot lies in a plane extending in right-angled relation to the plane of the narrow portion of said slot.

12. A bed frame as set forth in claim 2, in which the stud and slot means include studs respectively mounted on the side walls of the crossbar end portion, said studs each having a head portion and a shank portion, and associated inverted T-slots, each having a wide portion for initially receiving the stud head and a narrow portion for receiving the shank portion of the stud in the seated position of said crossbar end portion in said socket, the wide portion of said slot being formed in the bottom flange of the socket side wall and the narrow portion of said slot formed in the socket side wall.

13. In a bed frame having a pair of side rails and at least one end crossbar interconnected to provide a supporting frame structure for an associated box spring, the improvement in which an end of the crossbar is releasably connected with a side rail by means, comprising:

a. a bracket secured to the side rail, said bracket having walls coacting to form a socket for receiving an end portion of the connected crossbar into a seated position therein,
   said socket having a longitudinal axis extending parallel to the axis of the end portion of said crossbar seated therein, and
   said walls including spaced apart side walls lying on opposite sides of said axis;

b. said end portion of said crossbar having spaced apart side walls lying on opposite sides of its longitudinal axis,
   said side walls of said crossbar in said seated position being respectively juxtaposed to said side walls of said socket; and c. coacting parts between each of the juxtaposed side walls for interlocking engagement in said seated position for retaining said bracket against relative vertical tilting movements of the bracket with respect to the connected end portion of said crossbar.

14. A bed frame as set forth in claim 13, wherein said coacting parts comprise engageable stud and slot means adjacent the inner end of said bracket.

15. A bed frame as set forth in claim 13, wherein said coacting parts comprise engageable tongue and slot means adjacent the outer end of said bracket.

16. A bed frame as set forth in claim 15, in which the tongue is a fixed projection carried by the side wall of the crossbar end portion and the slot is formed on the side wall of the socket.

17. A bed frame as set forth in claim 13, wherein said coacting parts comprise:

open ended slots formed in one of the juxtaposed side walls, one of these slots being adjacent the inner end of said socket, and the other being adjacent the outer end of said socket,
   said slots having parallel inclined portions extending outwardly and downwardly with respect to the associated side rail; and
   projections carried by the other of said juxtaposed side walls adapted to respectively enter the slots in said seated position.

18. In a bed frame having a pair of side rails and at least one end crossbar interconnected to provide a supporting frame structure for an associated box spring, the improvement in which an end of the crossbar is releasably connected with a side rail by means comprising:

a. a bracket secured to the side rail, said bracket having walls coacting to form a socket for receiving an end portion of the connected crossbar into a seated position therein,
   said socket having a longitudinal axis extending parallel to the axis of the end portion of said crossbar seated therein, and
   said walls including spaced apart side walls lying on opposite sides of said axis;

b. said end portion of said crossbar having spaced apart side walls lying on opposite sides of its longitudinal axis,
   said side walls of said crossbar in said seated position being respectively juxtaposed to said side walls of said socket;

c. coacting parts between each of the juxtaposed side walls for interlocking engagement in said seated position to retain said end portion and said socket against axial separation,
   said parts including engageable interfacing surfaces respectively carried by the juxtaposed side walls and longitudinally extending generally along the longitudinal axes of said socket and seated end portion of the crossbar;

d. in which said bracket is in overlying relation to the end portion of the connected crossbar, and the weight of the supported box spring acts to force the overlying bracket in a downward direction towards such crossbar; and e. in which said interfacing engaged surfaces are downwardly inclined away from said side rail, whereby the weight of the box spring acts through the inclined interfacing surfaces to forceably maintain the bracket and crossbar end portion in connected relation and oppose attempted separation of the bracket from the crossbar end portion by lateral outward movement of the side rail.

* * * * *

UNITED STATES PATENT OFFICE

CERTIFICATE OF CORRECTION

Patent No. 3,984,884 Dated October 12, 1976

Inventor(s) Melvin P. Spitz

It is certified that error appears in the above-identified patent and that said Letters Patent are hereby corrected as shown below:

Column 10, line 29, "claim 2" should read --claim 1--.

line 37, "legs of U-shaped" should read --legs of a U-shaped--.

line 44, "claim 6" should read --claim 5--.

line 62, "claim 2" should read --claim 1--.

Signed and Sealed this

*Eighth* Day of *November 1977*

[SEAL]

*Attest:*

RUTH C. MASON
*Attesting Officer*

LUTRELLE F. PARKER
*Acting Commissioner of Patents and Trademarks*